US010738501B2

(12) United States Patent
Tracy

(10) Patent No.: US 10,738,501 B2
(45) Date of Patent: Aug. 11, 2020

(54) POLE TENT AND FRAME TENT SYSTEMS WITH VARIABLE TRANSITION SECTIONS

(71) Applicant: FRED'S TENTS & CANOPIES INC., Waterford, NY (US)

(72) Inventor: Fred Tracy, Stillwater, NY (US)

(73) Assignee: FRED'S TENTS & CANOPIES INC., Stillwater, NY (US)

( * ) Notice: Subject to any disclaimer, the term of this patent is extended or adjusted under 35 U.S.C. 154(b) by 0 days.

(21) Appl. No.: 16/385,053

(22) Filed: Apr. 16, 2019

(65) Prior Publication Data

US 2019/0242152 A1 Aug. 8, 2019

Related U.S. Application Data

(63) Continuation of application No. 15/795,886, filed on Oct. 27, 2017, now Pat. No. 10,301,839.

(51) Int. Cl.

| | |
|---|---|
| ***E04H 15/18*** | (2006.01) |
| ***E04H 15/34*** | (2006.01) |
| ***E04H 15/64*** | (2006.01) |
| ***E04H 15/60*** | (2006.01) |
| ***E04H 15/26*** | (2006.01) |

(52) U.S. Cl.

CPC ..... *E04H 15/18* (2013.01); *E04H 15/26* (2013.01); *E04H 15/34* (2013.01); *E04H 15/60* (2013.01); *E04H 15/64* (2013.01)

(58) Field of Classification Search

CPC ..... E04H 15/18
USPC ..... 135/97, 908
See application file for complete search history.

(56) References Cited

U.S. PATENT DOCUMENTS

| | | | |
|---|---|---|---|
| 1,607,020 | A | 11/1926 | Stoll |
| 1,728,356 | A | 9/1929 | Morgan |
| 2,932,304 | A | 4/1960 | Voege et al. |
| 3,282,274 | A | 11/1966 | Scott |
| 3,533,202 | A | 10/1970 | Gellert |
| 3,699,986 | A | 10/1972 | Kirkham |
| 3,810,481 | A | 5/1974 | Nohmura |
| 3,965,915 | A | 6/1976 | Kirkham |
| 5,394,897 | A | 3/1995 | Ritchey et al. |
| 7,845,121 | B2 | 12/2010 | Wobben |
| 9,470,010 | B2 | 10/2016 | Youn |
| 9,752,345 | B1 | 9/2017 | LaHood |
| 9,869,110 | B2 | 1/2018 | Krenzel |
| 2004/0238021 | A1 | 12/2004 | Holub et al. |
| 2007/0295377 | A1 | 12/2007 | Holub et al. |
| 2017/0089092 | A1 | 3/2017 | Krenzel |

*Primary Examiner* — Noah Chandler Hawk
(74) *Attorney, Agent, or Firm* — Heslin Rothenberg Farley & Mesiti PC

(57) ABSTRACT

A tent system including a first tent section having a first transition border. The first transition border is configured to receive a first support member at a first transition height. The first transition border has a first transition width. A first transition section is defined by the first transition border and a second transition border. The second transition border is configured to receive a second support member at a second transition height. The second transition border has a second transition width that is less than the first transition width. A flexible roof is configured to cover the first tent section and the first transition section. The flexible roof is configured to be supported by at least the first support member and second support member. The flexible roof is configured to cover the tent system.

9 Claims, 17 Drawing Sheets

POLE TENT AND FRAME TENT SYSTEMS WITH VARIABLE TRANSITION SECTIONS

CROSS SECTION TO RELATED APPLICATION

This application is a continuation of U.S. application Ser. No. 15/795,886, filed on Oct. 27, 2017. The entire disclosure of the prior application is hereby incorporated herein by reference.

TECHNICAL FIELD

The present invention relates to pole tent and frame tent systems. More specifically, the invention relates to pole tent and frame tent systems having transition sections with variable heights and widths.

BACKGROUND

Pole tents and frame tents are generally used for large commercial or personal events. By way of non-limiting examples, such events could be outdoor parties, outdoor receptions, commercial tent sales (such as for automobiles) or the like. Pole tents and frame tents are not typically used for overnight camping purposes. Pole tents and frame tents differ typically from camping tents because the floor, wall and roof are not one contiguous fabric. Rather such tents are used as structures to support a flexible roof to cover groups of persons, including hundreds of persons or more.

Pole tents and frame tents come in a variety of sizes, but generally have rectangular footprints. That is, the width at one end of a commercially available pole or frame tent will be substantially equal to the width at the other end.

Referring to prior art FIG. 1, perspective view of an exemplary embodiment of the inside of a typical prior art pole tent 10 is shown. Pole tents, like pole tent 10, use center poles 12 located at the center of the tent 10 and side poles 14 located at the perimeter of the tent 10 to support a flexible tent roof 16.

A pole tent 10 is secured and supported by driving stakes 18 into the ground and using tensioned cables 20 (or guy-lines) to tie the side poles 14 to the stakes 18. In a pole tent 10, all of the tension on the tent roof 16 is maintained by the stakes 18. As such, a pole tent 10 is not generally suitable to be installed over concrete or asphalt unless properly anchored with concrete anchors or the like.

Referring to prior art FIG. 2, perspective view of an exemplary embodiment of a prior art frame tent 30 is shown. Frame tents, like frame tent 30, use a frame 32 (or frame work) to maintain tension on the roof 34 of the frame tent 30. The frame 32 is constructed of interconnecting frame poles 36 that are typically composed of aluminum tubing. Side poles 38 elevate and support the frame 32 and roof 34 off of the ground.

The frame 32 of a frame tent 30 does not require stakes to keep the roof in tension, therefore allowing more flexibility in placement than a pole tent. However, even though the frame tent 32 has free standing characteristics, tensioned cables 40 are still used to secure the tent 30 to stakes 42 when the frame tent is located outside. When located inside a building, staking or anchoring the frame tent 30 is not required.

Referring to FIGS. 3A and 3B, a top view (FIG. 3A) and a side view (FIG. 3B) of an exemplary embodiment of prior art pole tents 50 and 60 of different sizes are shown. The pole tents 50, 60 represent two different sized tents, but both have the rectangular footprint that is typical of commercially available pole tents. That is, the width 52 of pole tent 50 at one tent end 54 is substantially equal to the width 52 at the other tent end 56. Additionally, the width 62 of the pole tent 60 at one tent end 64 is also substantially equal to the width 62 at the other end 66. Though this example used pole tents 50, 60, frame tents could have also been used in this example, since frame tent footprints are also typically rectangular in shape.

Often times, however, there is a requirement for tents to cover areas with non-rectangular, or irregular, shapes. Under such conditions, different sized rectangular shaped tents, like tents 50 and 60, are used to cover the irregular shaped surface areas.

Disadvantageously, though, using multiple tents can be more expensive and take longer to construct than a single tent system. Further, the multiple tents can obstruct the view from one tent to another. Additionally, the rectangular footprints of the tents do not always fit well over the irregular shaped surface they need to cover. Finally, since each tent is separate, the area between the tents is prone to leaks.

Accordingly, there is a need for a tent system that includes variable transition sections. The transition sections would enable tent sections of different widths and height to be connected together under a single roof to form a tent system that has a non-rectangular shape. The irregularly shaped tent system could conform more closely to an irregularly shaped surface area than multiple rectangular shaped tents could. Additionally, there would be less obstruction of view in such an irregularly shaped tent system than that of multiple rectangular shaped tents.

BRIEF DESCRIPTION

The present invention offers advantages and alternatives over the prior art by providing a tent system with variable transition sections. The transition sections enable tent sections of different widths to be connected together under a single unitary flexible roof to form the tent system.

A tent system in accordance with one or more aspects of the present invention includes a first tent section having a first transition border. The first transition border is configured to receive a first support member at a first transition height. The first transition border has a first transition width. A first transition section is defined by the first transition border and a second transition border. The second transition border is configured to receive a second support member at a second transition height. The second transition border has a second transition width that is less than the first transition width. A flexible roof is configured to cover the first tent section and the first transition section. The flexible roof is configured to be supported by at least the first support member and second support member. The flexible roof is configured to cover the tent system.

Another tent system in accordance with one or more aspects of the present invention includes a first tent section defined by a first tent section end and a first transition border. The first transition border is configured to receive a first support member at a first transition height. The first transition border has a first transition width. A first transition section is defined by the first transition border and a second transition border. The second transition border is configured to receive a second support member at a second transition height. The second transition border has a second transition width that is less than the first transition width. A flexible roof is configured to cover the first tent section and the first transition section. The flexible roof is configured to be supported by at least the first support member and second support member. The flexible roof is configured to cover the tent system.

DRAWINGS

The invention will be more fully understood from the following detailed description taken in conjunction with the accompanying drawings, in which.

DETAILED DESCRIPTION

Figure 1:
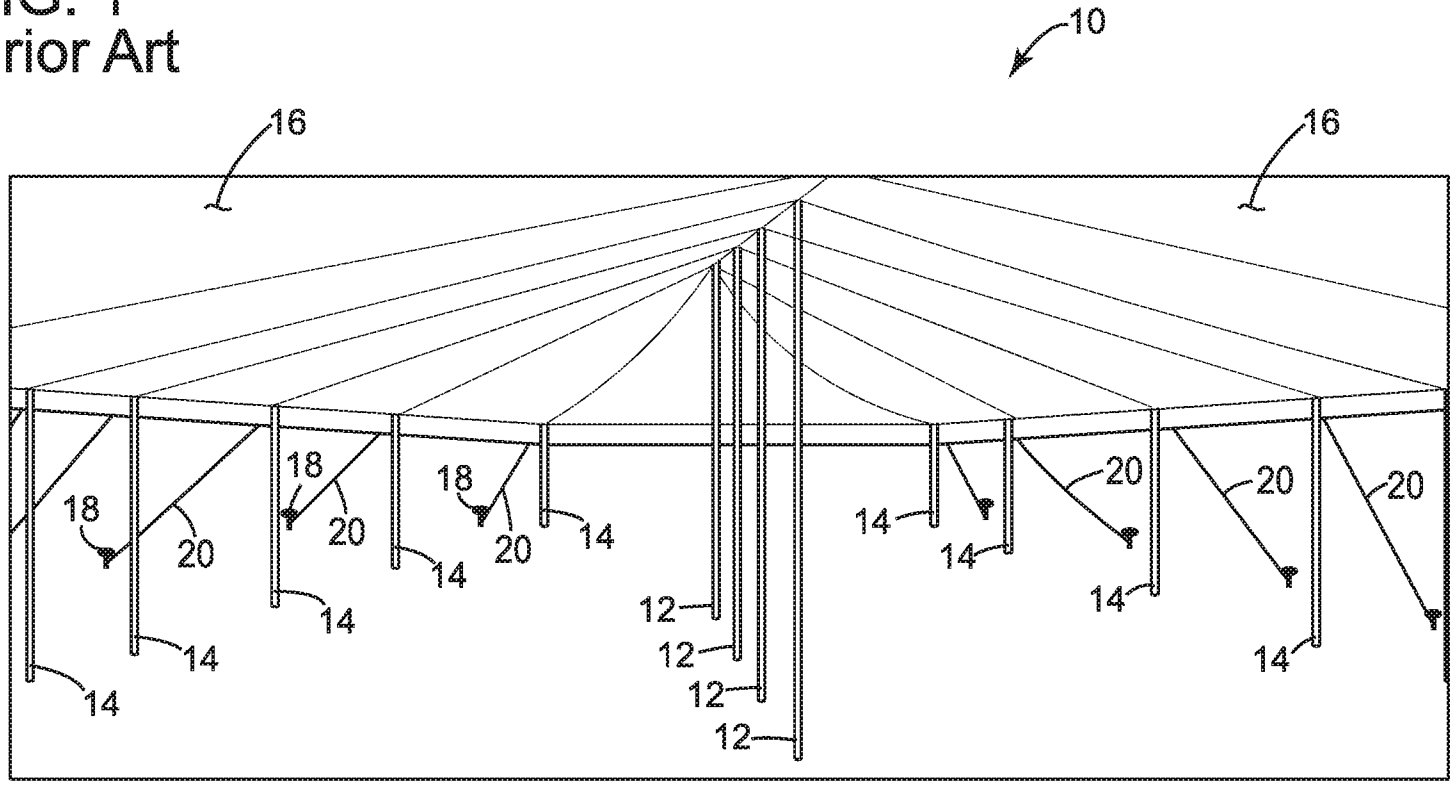
FIG. 1 Prior Art
FIG. 1 is a perspective view of an exemplary embodiment of the inside of a typical prior art pole tent.
Figure 2:
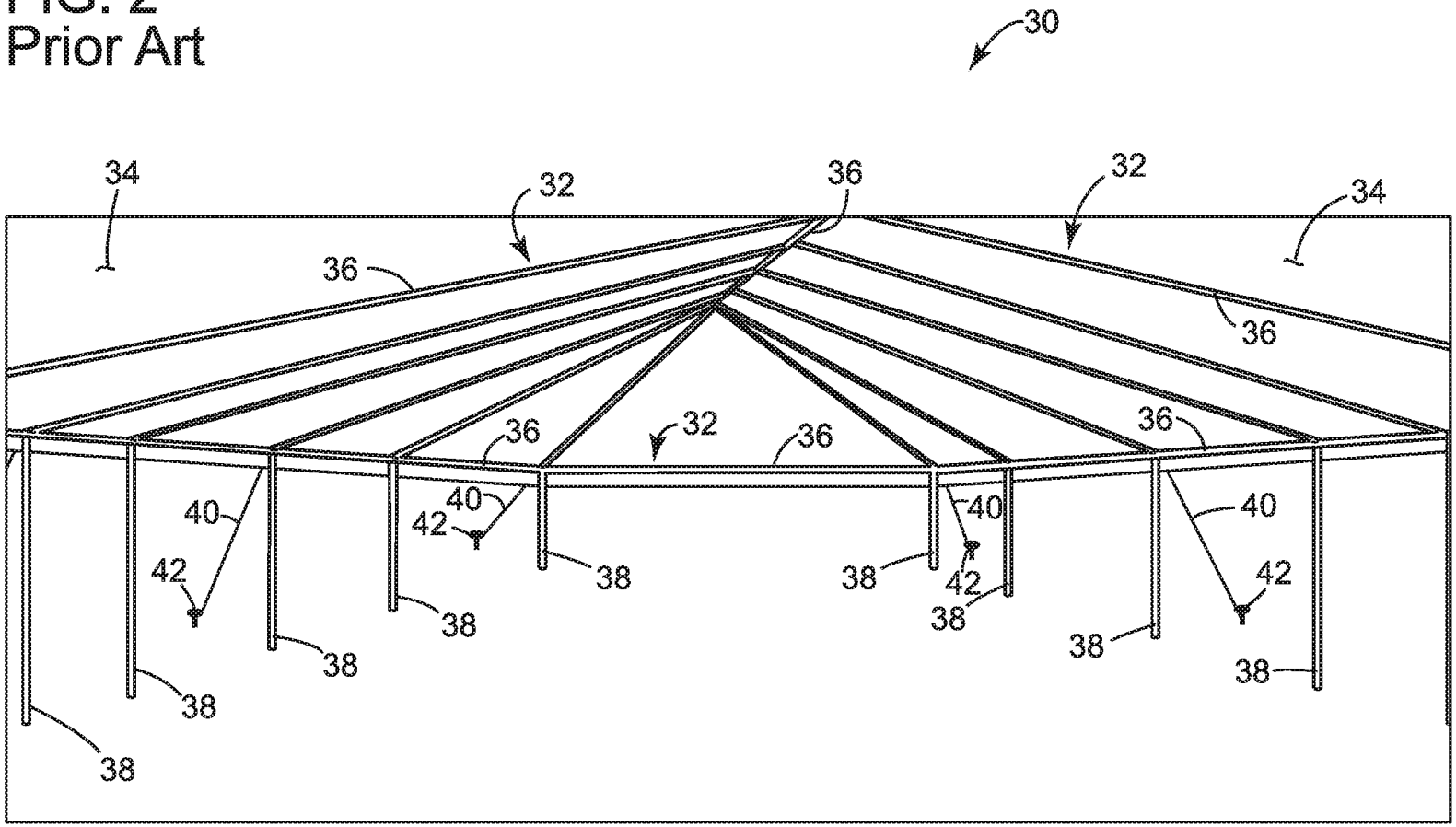
FIG. 2 Prior Art
FIG. 2 is a perspective view of an exemplary embodiment of the inside of a prior art frame tent.
Figure 3A:
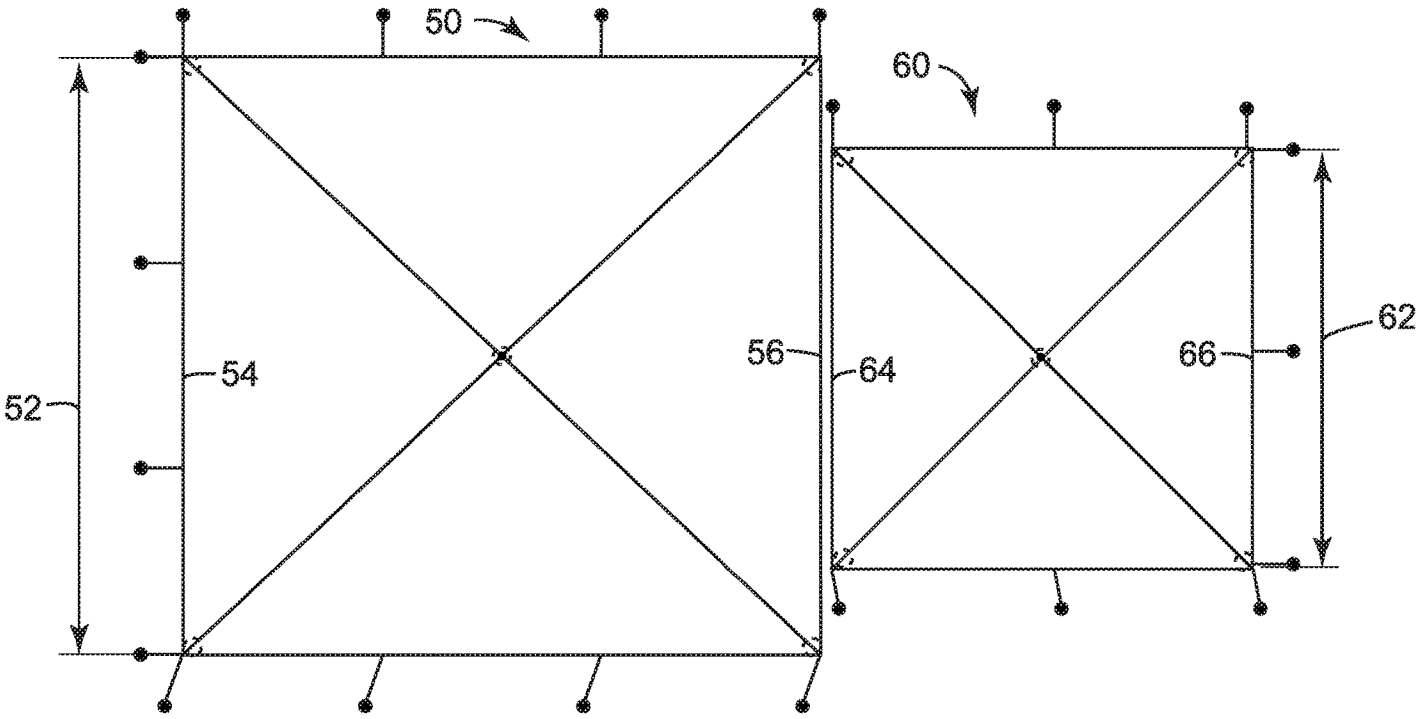
FIG. 3A Prior Art
FIG. 3A is a top view of an exemplary embodiment of prior art pole tents of different sizes.
Figure 3B:
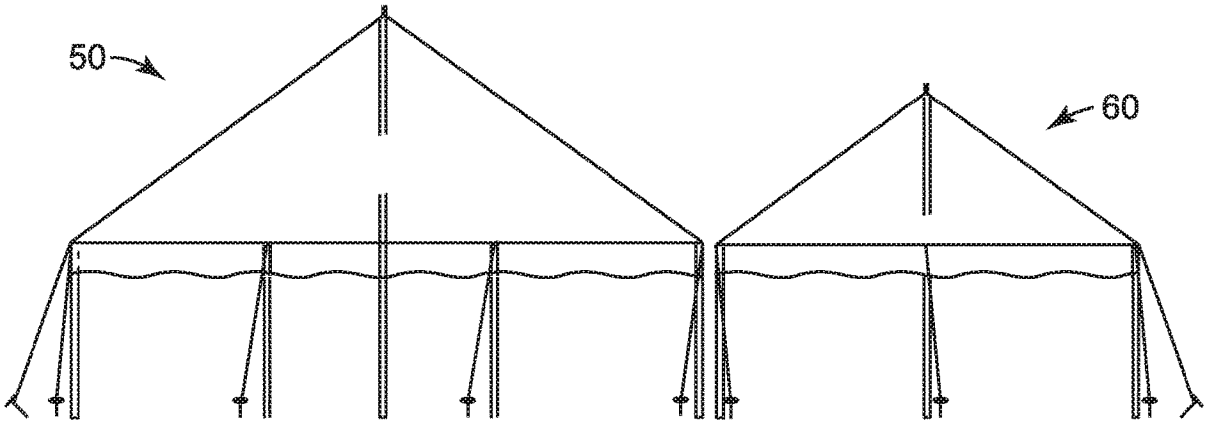
FIG. 3B Prior Art
FIG. 3B is a side view of an exemplary embodiment of the prior art pole tents of FIG. 3A.

Certain exemplary embodiments will now be described to provide an overall understanding of the principles of the structure, function, manufacture, and use of the methods, systems, and devices disclosed herein. One or more examples of these embodiments are illustrated in the accompanying drawings. Such drawings depict tent systems which are symmetrical along their length. Thus only one side view of each exemplary embodiment is provided and it is understood that opposite side views, as being symmetrical, are unnecessary. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

For purposes of clarity and as used herein, pole tents can commonly be divided into the following two types of pole tents:

"pole-supported" pole tents; and

"tensile" pole tents.

Also for purposes of clarity and as used herein, frame tents can commonly be divided into the following two types of frame tents "pipe frame-supported" frame tents; and "box-beam, frame-supported" frame tents.

Pole-supported pole tents (also called "Pole-supported tents" or "free span tents") are tents that feature a set of individual poles, which are utilized as support members. The poles are arranged beneath a fabric roof to support and define the shape of the structure. The fabric roof is tensioned over the poles and attached to ropes and/or cables at designated spots around the fabric's edge. The ropes/cables are anchored to the ground using stakes, augers, weights or the like around the perimeter of the tent.

Tensile pole tents are structures that share some characteristics with the pole-supported tents (such as individual poles as support members), but rely more on the tensioning of the fabric roof for its structural integrity and shape. The use of tensioned fabric to resist applied loads and to shape the fabric membrane means less of a traditional support structure is needed to maintain the tent.

Pipe frame-supported frame tents (also called pipe frame-supported tents) are tents with an assembled framework made of aluminum or steel pipes, tubes, other extrusions or the like, which are utilized as support members. The assembled framework supports the fabric roof and defines the shape of the structure. The rigid framework allows the tent to be free-standing without additional support. However, such pipe frame-supported tents require the same, or similar, rope or cable anchoring system as pole-supported tents to hold in place, as specified by applicable fire codes, building codes or the like.

Box-beam, frame supported frame tents (also called box-beam frame-supported tents, "clear-span" tents or "free-span" tents) are tents that feature an assembled framework of box-beams, I-beams or truss arches, which are utilized as support members. The framework supports the fabric roof and defines the shape of the structure.

Figure 4A:
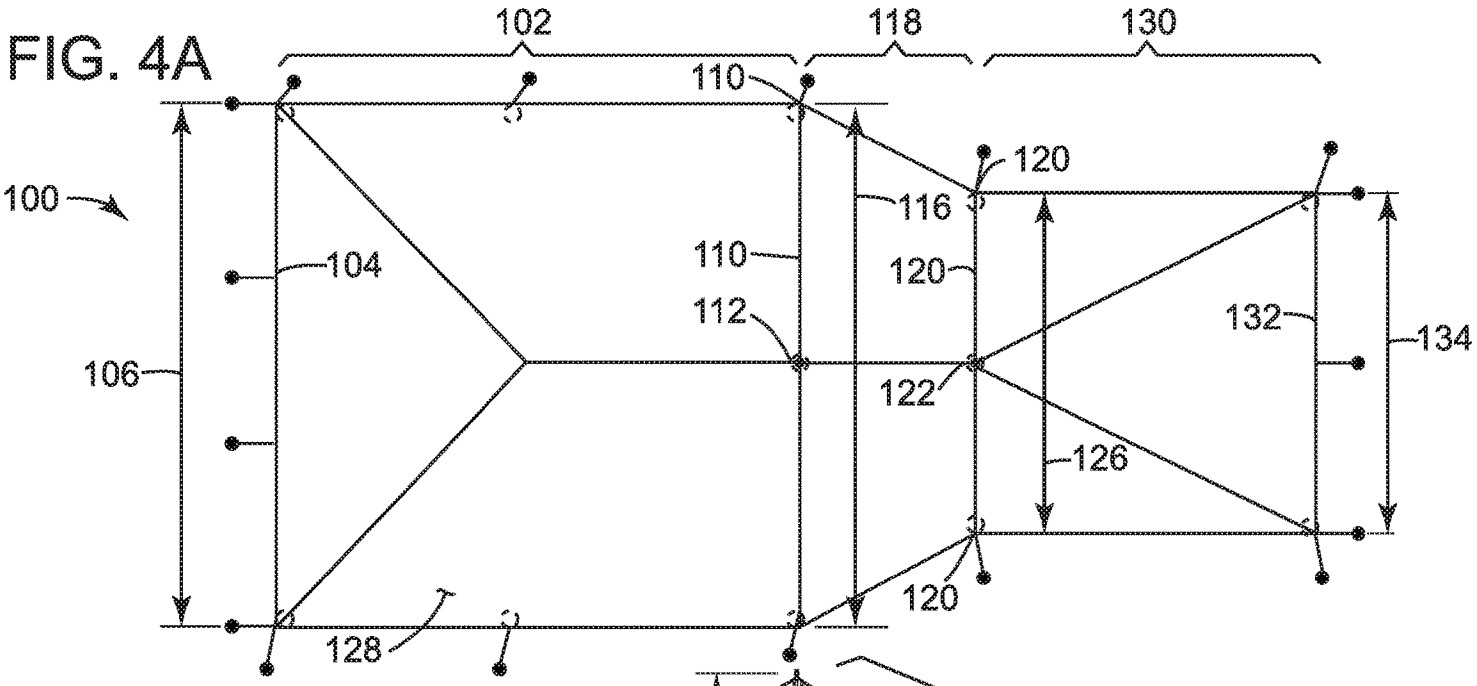
FIG. 4A is a top view of an exemplary embodiment of a center pole tent system in accordance with the present invention.
Figure 4B:
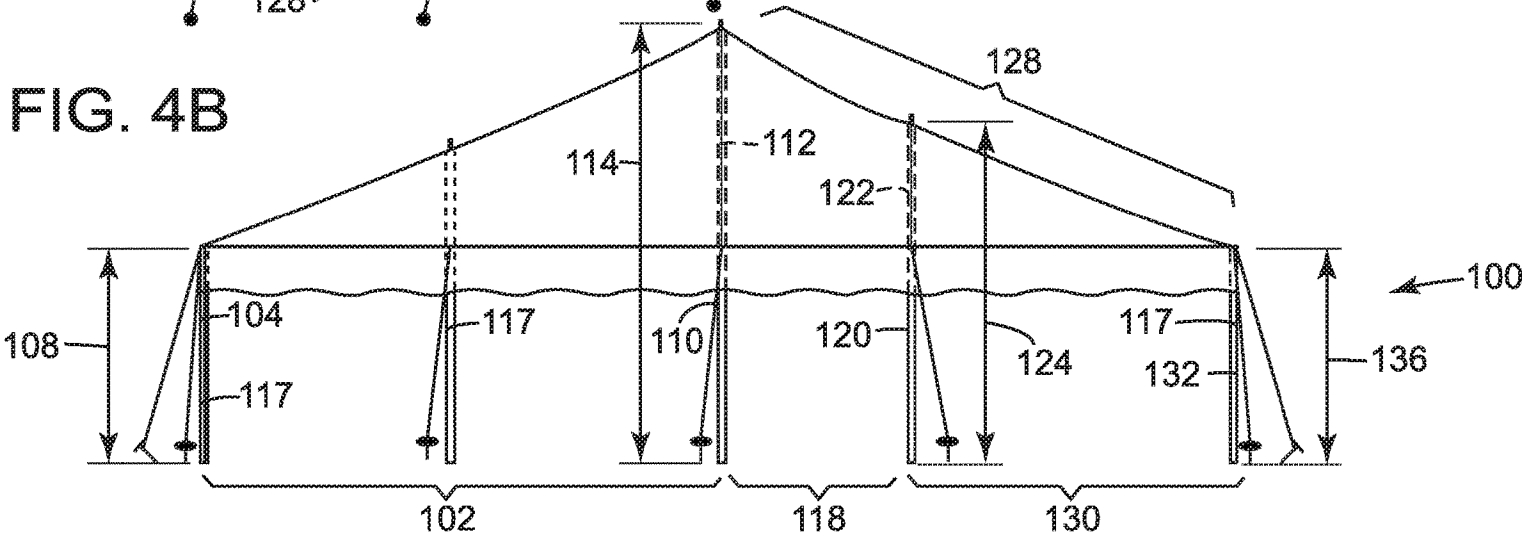
FIG. 4B is a side view of an exemplary embodiment of the center pole tent system of FIG. 4A in accordance with the present invention.

Referring to FIGS. 4A and 4B, a top view (FIG. 4A) and a side view (FIG. 4B) of an exemplary embodiment of a pole tent system (herein referred to as a "tent system") 100 in accordance with the present invention is presented. The tent system 100 includes a first tent section 102 defined by a first tent section end 104 and a first transition border 110. The first tent section end includes a first tent section end width 106 and a first tent section end height 108. The first transition border 110 is located at the opposite end of the first tent section 102 and is configured to receive a first support member 112 at a first transition height 114. The first transition border also has a first transition width 116.

The first support member 112, as with all of the support members in this embodiment, is a center pole since the exemplary tent system 100 is a pole tent system. However, the tent system 100 could just as readily be a frame tent system (also referred to herein as a "tent system") and the support members could be frames, or portions of frames, that are used to support the roof 128.

Unlike camping tent systems used for camping purposes, the tent system 100 does not have a tent floor. Camping tent systems have different design requirements than the tent system 100 due to the need to provide protection from the elements when used in remote locations. For example, camping tents must be compact and have floors to preserve body heat. On the other hand, frame and center pole tent systems can be up to 40 feet long and 18 feet high, and larger, and do not have floors.

Further, the perimeter of the tent system 100 is supported by a plurality of side poles 117. This would be true for a pole tent system or a frame tent system.

A first transition section 118 defined by the first transition border 110 at one end and a second transition border 120 at an opposite end of the first transition section 118. The second transition border 120 is configured to receive a second support member 122 (i.e., a center pole) at a second transition height 124 that is less than the first transition height 114. The second transition border 120 also has a second transition width 126 that is less than the first transition width 116.

The tent system 100 also includes a second tent section 130. The second tent section 130 is defined by the second transition border 120 at one end of the second tent section 130 and a second tent section end 132 at an opposite end of the second tent section 130.

The second tent section end 132, in this embodiment, is located at the extreme end of the tent system 100, and has a second tent section end width 134 and a second tent section end height 136. In the embodiment illustrated in FIGS. 4A and 4B, the second tent section end width 134 is substantially equal to the second transition width 126, which gives the second tent section 130 a generally rectangular footprint. The second tent section height 136, in this embodiment, is essentially the height of the side poles 117. The height of the side poles 117 is typically less than the height of the first and second transition heights 114, 124.

A flexible roof 128 is configured to cover the first tent section 102, the first transition section 118 and the second tent section 130. The flexible roof is configured to be supported by at least the first support member 112 and second support member 122. The flexible roof is configured to cover the entire tent system 100.

A transition section, like the first transition section 118, is used to provide a contiguous transition between tent sections of the tent system 100. In this case, the transition section 118 provides a transition from a wider width 116 at an end (in this case the first transition border 110) of the first tent section 102 to a narrower width 126 at an end (in this case the second transition border 120) of the second tent section 130.

Within a transition section, such as first transition section 188, when the width varies, the height may (though not necessarily) also vary. Therefore, when widths 116, 126 vary from wider to narrower respectively, than the peak heights 114, 124 at each transition border 110, 120 may also vary from the taller height 114 to the shorter height 124.

Figure 5A:
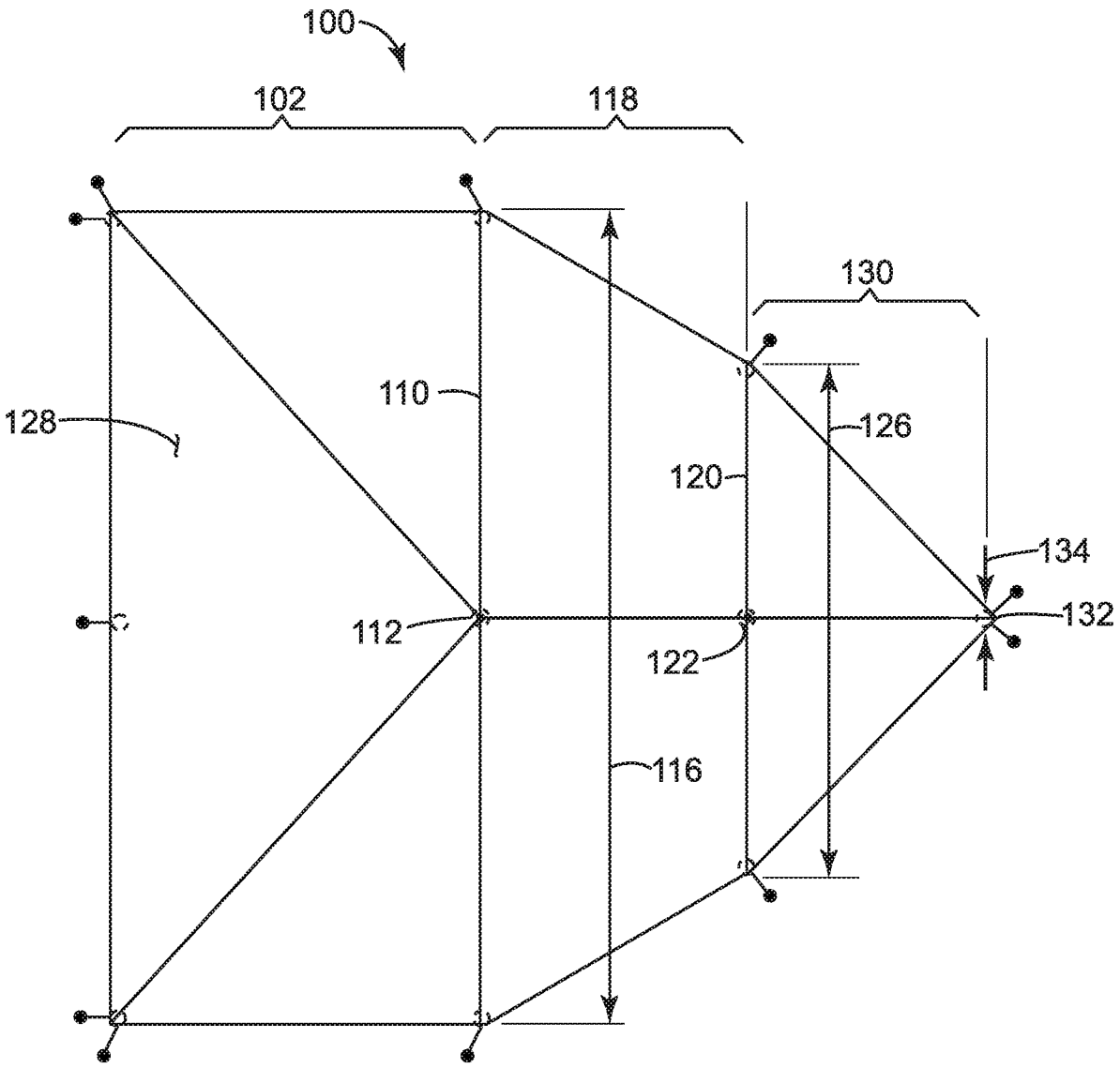
FIG. 5A is a top view of another exemplary embodiment of the center tent system in accordance with the present invention.
Figure 5B:
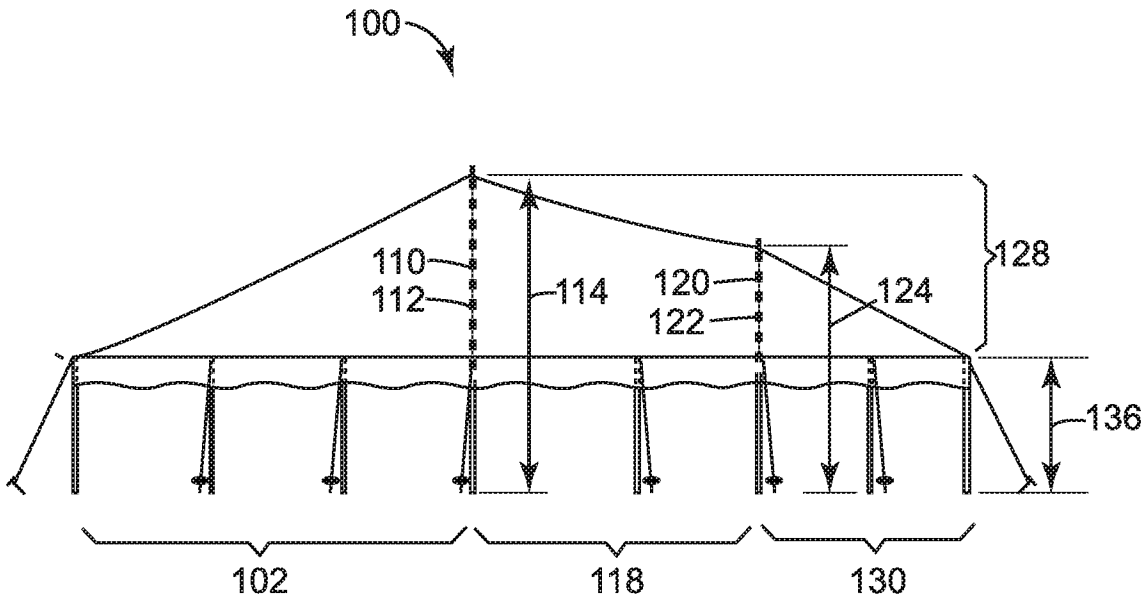
FIG. 5B is a side view of the exemplary embodiment of the center pole tent system of FIG. 5A in accordance with the present invention.

Referring to FIGS. 5A and 5B, a top view (FIG. 5A) and a side view (FIG. 5B) of another exemplary embodiment of the tent system 100 in accordance with the present invention is presented. In this embodiment, the second tent section 130 is illustrated as having a varying width that ultimately forms an apex at the second tent section end 132. Therefore, the second tent section end width 134 is less than the second transition width 126 because the width 134 is narrowed to the width of a pole. Additionally, the second tent section end height 136 is also less than the second transition height 124.

Figure 6A:
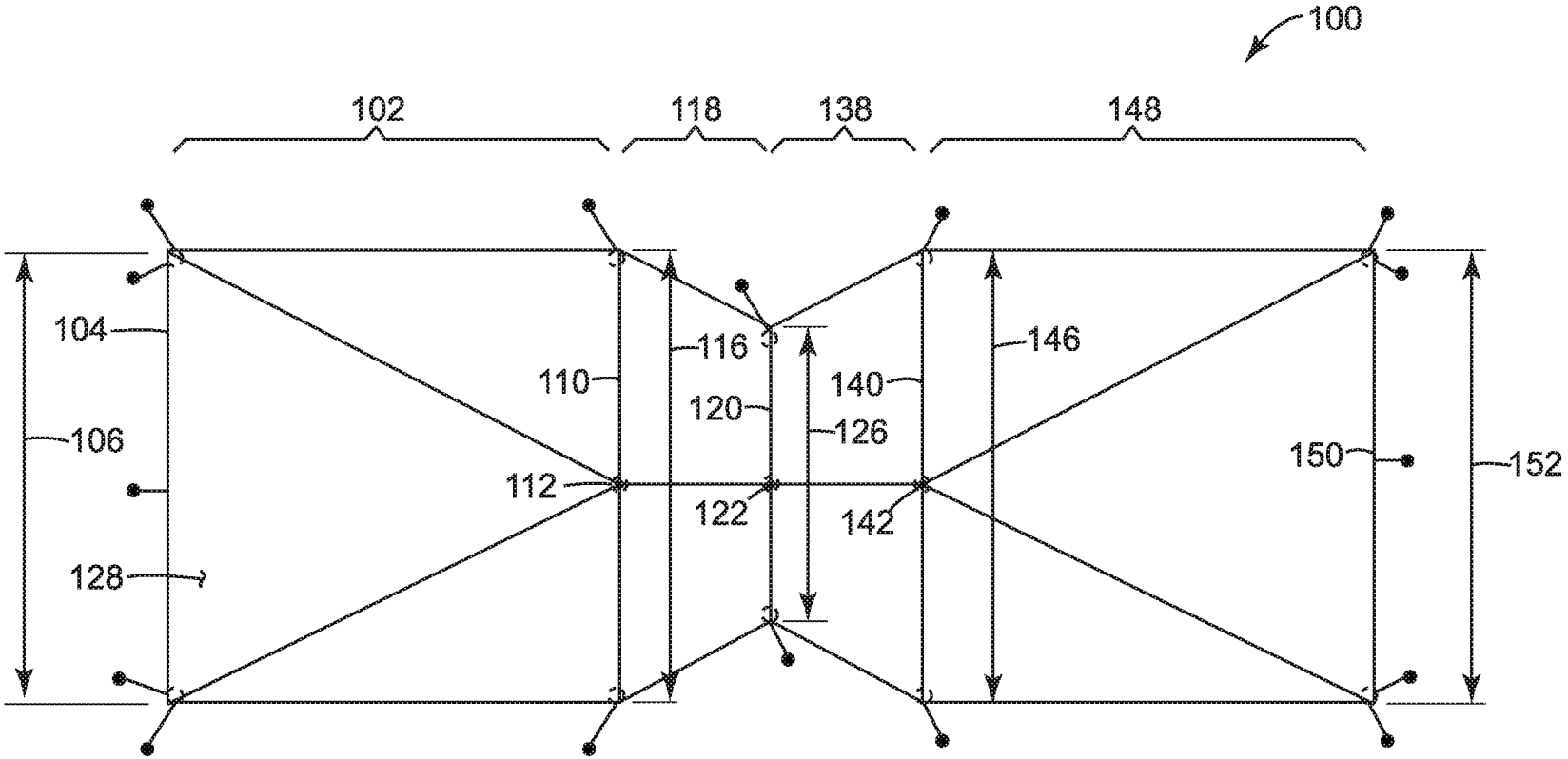
FIG. 6A is a top view of another exemplary embodiment of the center pole tent system in accordance with the present invention.
Figure 6B:
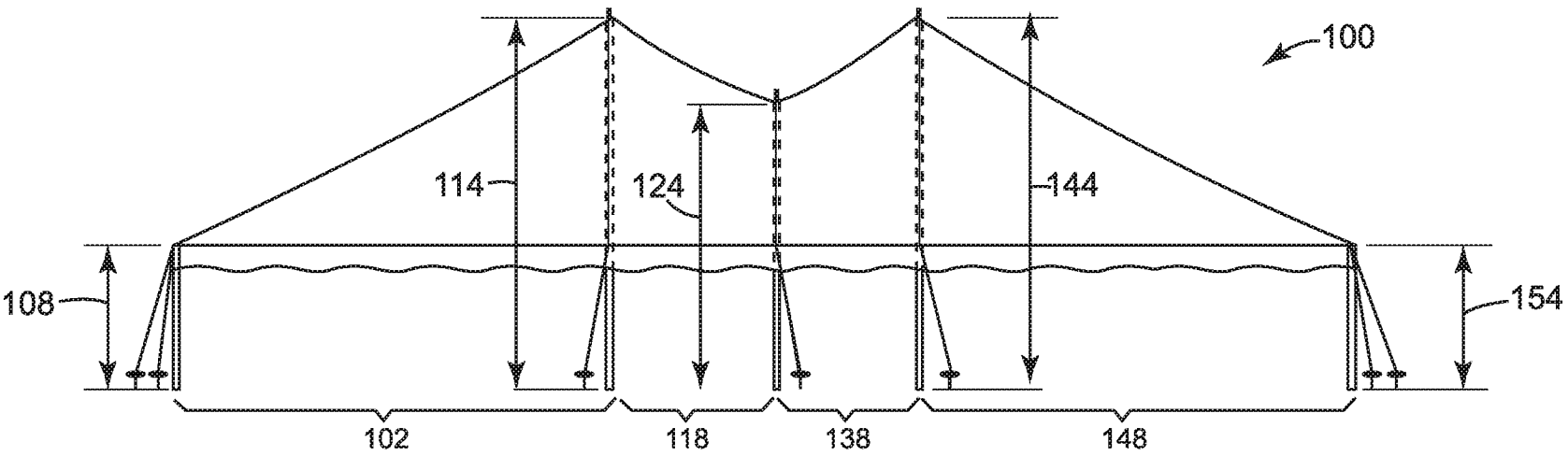
FIG. 6B is a side view of the exemplary embodiment of the center pole tent system of FIG. 6A in accordance with the present invention.

Referring to FIGS. 6A and 6B, a top view (FIG. 6A) and a side view (FIG. 6B) of another exemplary embodiment of the tent system 100 in accordance with the present invention is presented. In this embodiment, a second tent section 148 is illustrated as being connected to the first tent section 102 with two consecutive transition sections 118 and 138. The second tent section 148 has a width 152 that is substantially equal to the width 106 of the first tent section 102.

In the tent system 100 of the embodiment illustrated in FIGS. 6A and 6B, the transition section actually includes a plurality of transition sections 118 and 138. Each transition section 118, 138 is defined between adjacent transition borders (110 and 120 for transition section 118) (120 and 140 for transition section 138) of different transition widths 116, 126, 146 and transition heights 114, 124, 144.

More specifically, the tent system 100 of FIGS. 6A and 6B includes the first transition section 118 and a second transition section 138. The second transition section 138 is defined by the second transition border 120 on one end of the second transition section 138 and by a third transition border 140 on an opposite end of the second transition section 138. The third transition border 140 is configured to receive a third support member 142 (in this case a center pole) at a third transition height 144 that is greater than the second transition height 124. The third transition border 140 has a third transition width 146 that is greater than the second transition width 126.

The tent system 100, of the embodiment illustrated in FIGS. 6A and 6B, also includes a second tent section 148 that is defined by the third transition border 140 on one end and a second tent section end 150 on an opposite end of the second tent section 148. The second tent section end 150 has a second tent section end width 152 and a second tent section end height 154.

In this embodiment the second tent section end width 152 is substantially equal to the third transition width 146 and the second tent section end height 154 is substantially less than to the third transition height 144. Additionally, the third transition height 144 is substantially equal to the first transition height 124 and the third transition width 146 is substantially equal to the first transition width 116.

Figure 7A:
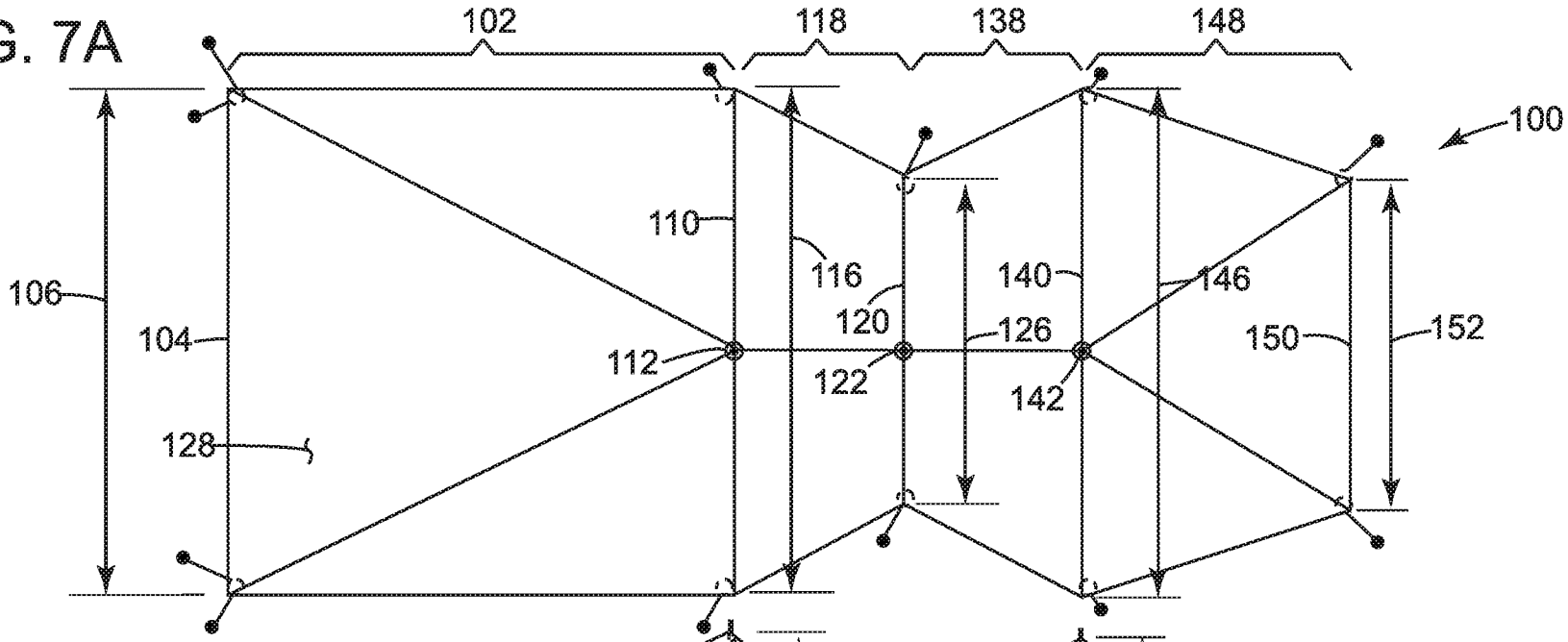
FIG. 7A is a top view of another exemplary embodiment of the center pole tent system in accordance with the present invention.
Figure 7B:
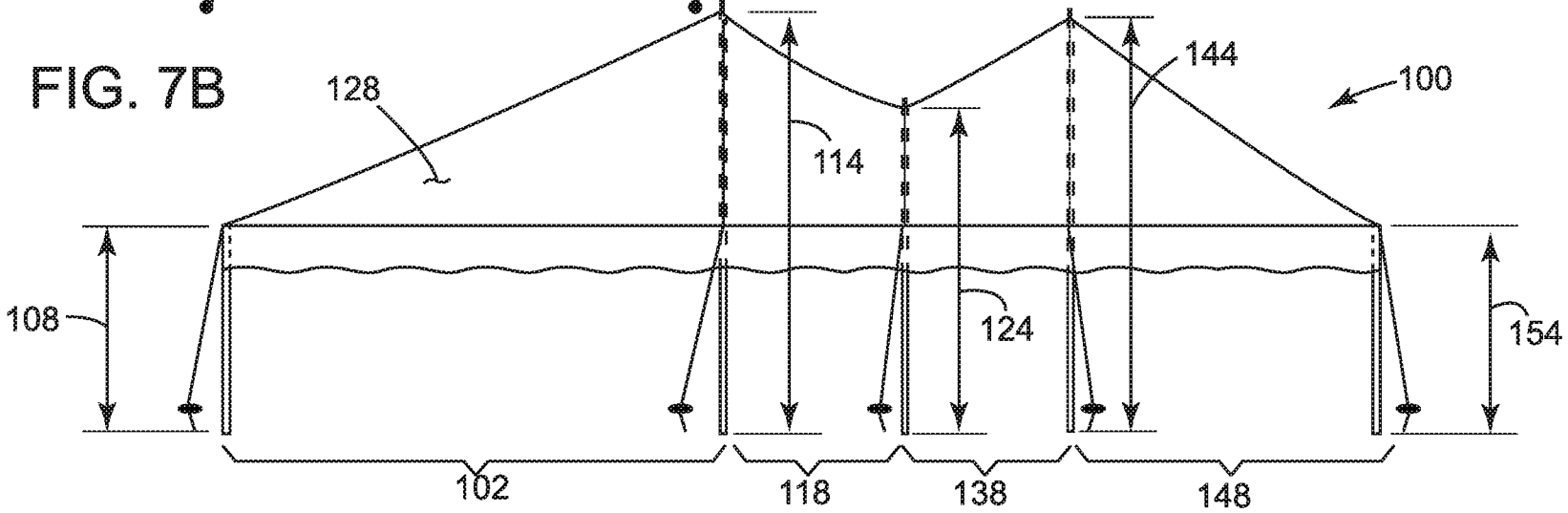
FIG. 7B is a side view of the exemplary embodiment of the center pole tent system of FIG. 7A in accordance with the present invention.

Referring to FIGS. 7A and 7B, a top view (FIG. 7A) and a side view (FIG. 7B) of another exemplary embodiment of the tent system 100 in accordance with the present invention is presented. In this embodiment, the second tent section 148 is illustrated as having a varying width. Therefore, the second tent section end width 150 is less than the third transition width 146. Additionally, the second tent section end height 154 is also less than the third transition height 144.

Figures 8A, 8B:
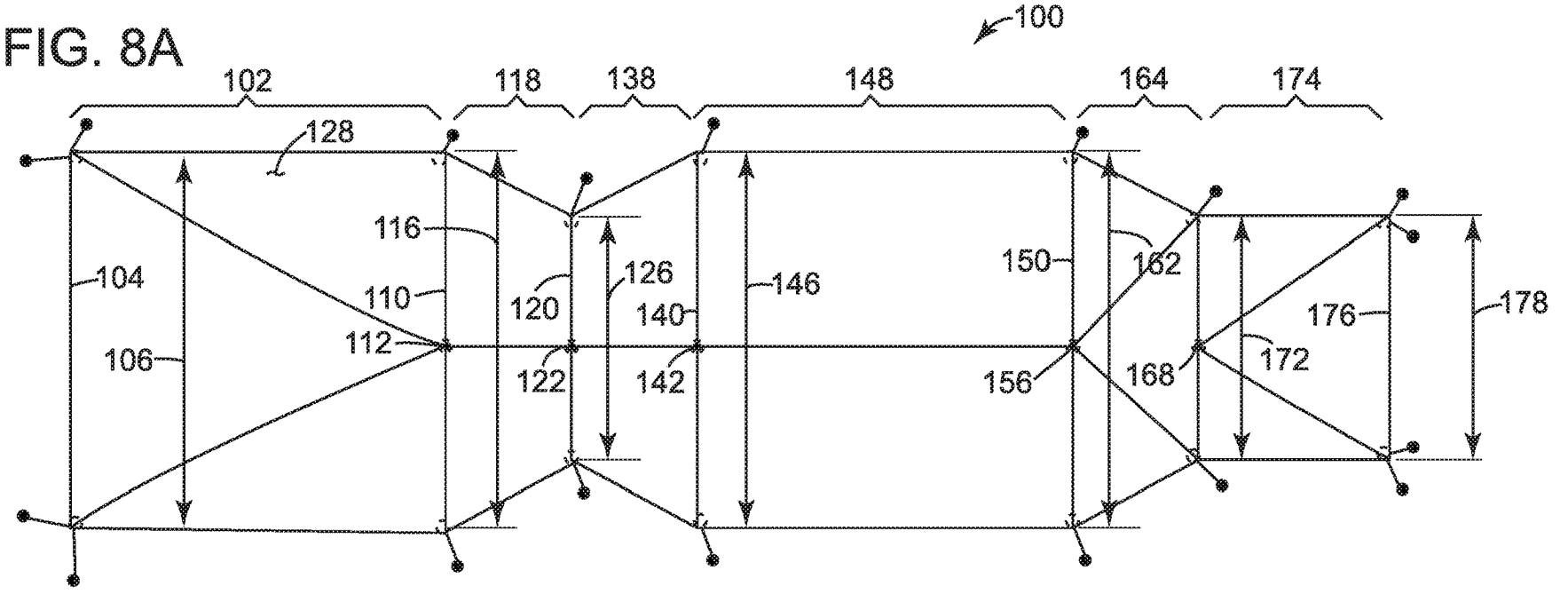
FIG. 8A is a top view of another exemplary embodiment of the center pole tent system in accordance with the present invention.
FIG. 8B is a side view of the exemplary embodiment of the center pole tent system of FIG. 8A in accordance with the present invention.

Referring to FIGS. 8A and 8B, a top view (FIG. 8A) and a side view (FIG. 8B) of another exemplary embodiment of the tent system 100 in accordance with the present invention is presented. This embodiment is similar to the embodiment illustrated in FIGS. 6A and 6B, except that an additional third transition section 164 and third tent section 174 have been added on.

In the embodiment illustrated in FIGS. 8A and 8B of the tent system 100, the second tent section end 150 is a fourth transition border 150. The fourth transition border 150 is configured to receive a fourth support member 156 at a fourth transition height 158. Additionally, the fourth transition border 150 has a fourth transition width 162.

A third transition section 164 is defined by the fourth transition border 150 and a fifth transition border 166. The fifth transition border 166 is configured to receive a fifth support member 168 (in this case a center pole) at a fifth transition height 170 that is less than the fourth transition height 158. The fifth transition border 166 has a fifth transition width 172 that is less than the fourth transition width 162.

Additionally, a third tent section 174 is defined by the fifth transition border 166 and a third tent section end 176. The third tent section end 176 has a third tent section end width 178 and a third tent section end height 180. The third tent section end width 178 is substantially equal to the fifth transition width 172 and the third tent section end height 180 is less than to the fifth transition height 158.

Figure 9A:
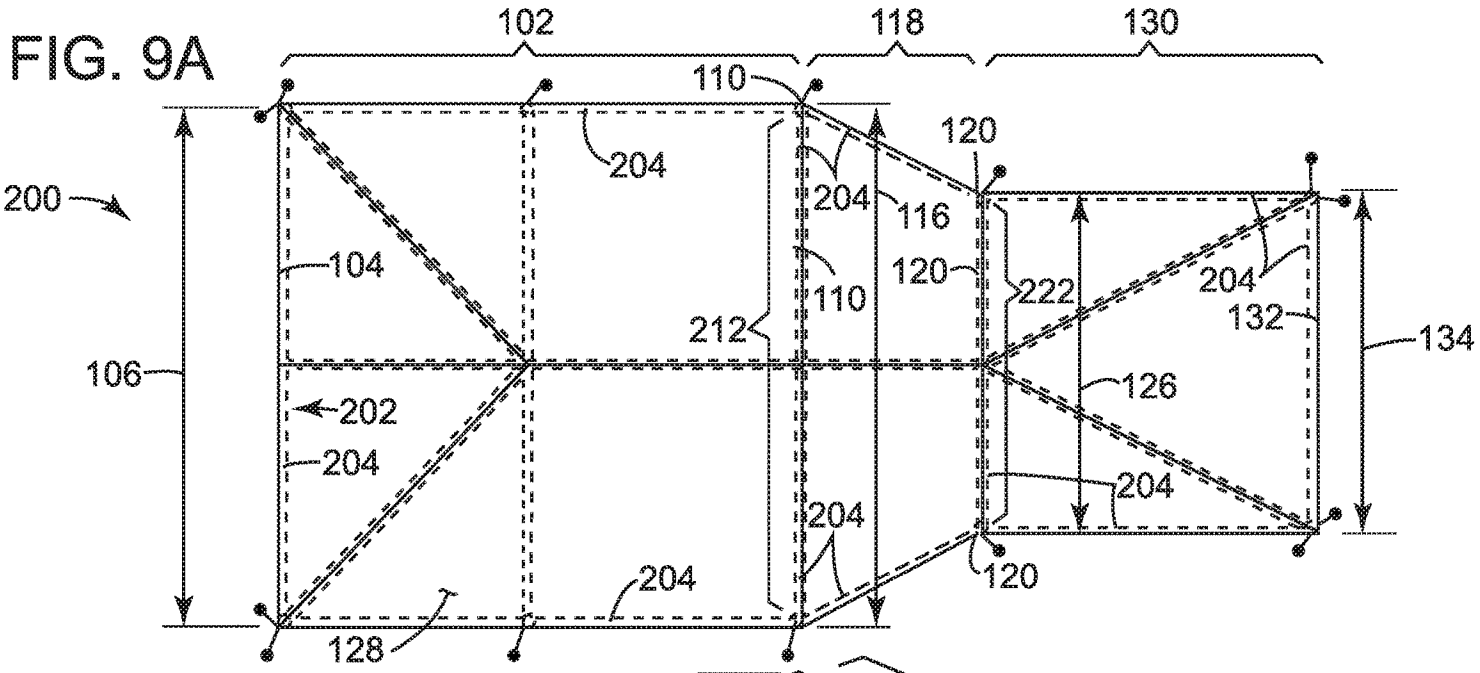
FIG. 9A is a top view of an exemplary embodiment of a frame tent system in accordance with the present invention.

The following FIGS. 9A and B through 13A and B illustrate exemplary embodiments of a frame tent system 200 in accordance with the present invention. The embodiments of frame tent system 200 differ from the embodiments of pole tent system 100 in that a frame replaces the center poles as the main support structure for the tent roof. However, the tent systems 100 and 200 are substantially similar in most other aspects. Therefore, the same reference numbers used in illustrating tent system 100 are utilized in illustrating like features of tent system 200.

Figure 9B:
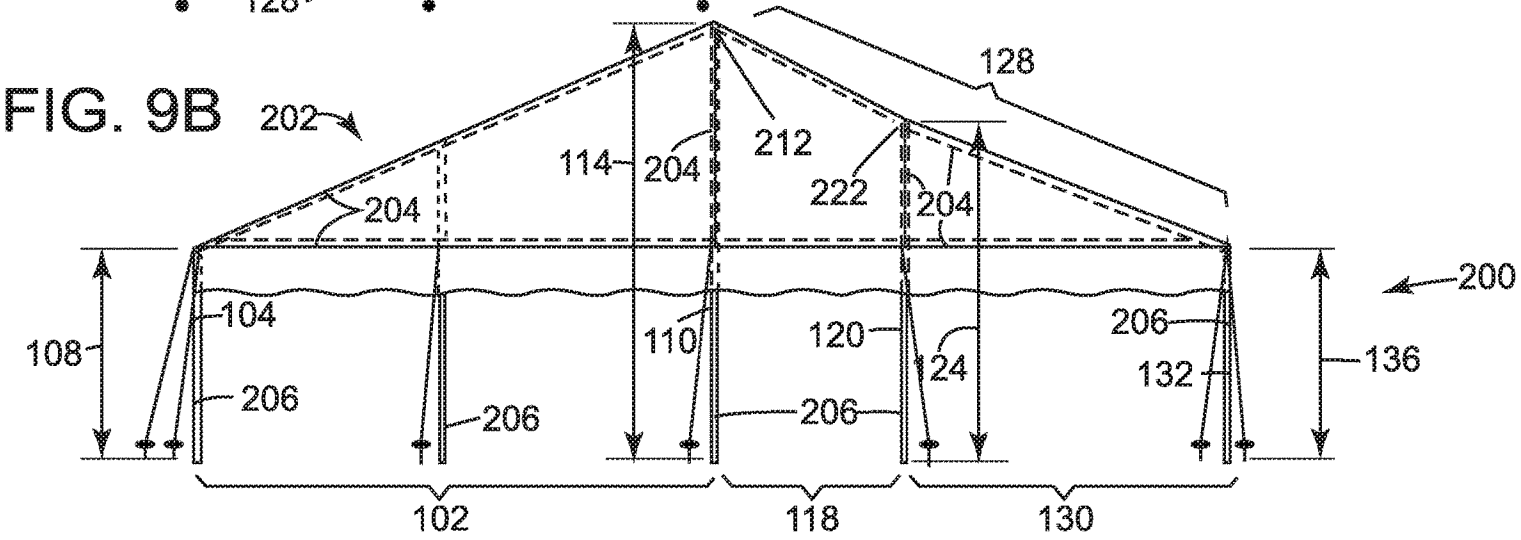
FIG. 9B is a side view of an exemplary embodiment of the frame tent system of FIG. 9A in accordance with the present invention.

Referring to FIGS. 9A and 9B, a top view (FIG. 9A) and a side view (FIG. 9B) of an exemplary embodiment of the tent system 200 in accordance with the present invention is presented. The tent system 200 includes a tent frame 202 that is composed of a plurality of frame poles 204. The frame poles 204 are connected together to outline the perimeter of the tent roof 128 and to form a series of generally triangular shaped trusses which shape and support the tent roof 128. The frame 202 is elevated and supported off of the ground by a plurality of side poles 206. No center poles are used to support the roof 128.

Unlike camping tent systems used for camping purposes, the tent system 200 does not have a tent floor. Camping tent systems have different design requirements than the tent system 200 due to the need to provide protection from the elements when used in remote locations. For example, camping tents must be compact and have floors to preserve body heat. On the other hand, frame and center pole tent systems can be up to 40 feet long and larger and do not have floors.

Similar to the embodiment illustrated in the pole tent system 100 of FIGS. 4A and 4B, the frame tent system 200 includes a first tent section 102 defined by a first tent section end 104 and a first transition border 110. The first tent section end includes a first tent section end width 106 and a first tent section end height 108. The first transition border 110 is located at the opposite end of the first tent section 102 and is configured to receive a first support member 212 at a first transition height 114. The first transition border also has a first transition width 116.

Though the first tent section end 104 is located at the very distal end of the entire tent system 100 in this embodiment, it is important to note that this may not always be the case. The first tent section end 104 (and any other tent section end discussed herein) does not define the distal end of the entire tent system 100. Rather it represents an end of a tent section (such as the first tent section 102), which can be located between other adjacent tent sections of the tent system.

However, in contrast to the first support member 112 of FIGS. 4A and 4B, the first support member 212 of FIGS. 9A and 9B is a frame pole 204 rather than a center pole. The first support member 212 is a portion of the frame 202 that extends laterally across a peak of the tent roof 128 at the first transition height 114.

A first transition section 118 is defined by the first transition border 110 at one end and a second transition border 120 at an opposite end of the first transition section 118. The second transition border 120 is configured to receive a second support member 222 at a second transition height 124 that is less than the first transition height 114. The second transition border 120 also has a second transition width 126 that is less than the first transition width 116.

Again, in contrast to the second support member 122 of FIGS. 4A and 4B, the second support member 222 of FIGS. 9A and 9B is a frame pole 204 rather than a center pole. The second support member 222 is a portion of the frame 202 that extends laterally across a peak of the tent roof 128 at the second transition height 116.

The tent system 200 also includes a second tent section 130. The second tent section 130 is defined by the second transition border 120 at one end of the second tent section 130 and a second tent section end 132 at an opposite end of the second tent section 130.

The second tent section end 132, in this embodiment, is located at the extreme end of the tent system 200, and has a second tent section end width 134 and a second tent section end height 136. In the embodiment illustrated in FIGS. 9A and 9B, the second tent section end width 134 is substantially equal to the second transition width 126, which gives the second tent section 130 a generally rectangular footprint. The second tent section height 136, in this embodiment, is essentially the height of the side poles 117. The height of the side poles 117 is typically less than the height of the first and second transition heights 114, 124.

The flexible roof 128 is configured to cover the first tent section 102, the first transition section 118 and the second tent section 130. The flexible roof is configured to be supported by at least the first support member 212 and second support member 222. The flexible roof is configured to cover the entire tent system 200.

A transition section, like the first transition section 118, is used to provide a contiguous transition between tent sections of the tent system 200. In this case, the transition section 118 provides a transition from a wider width 116 at an end (in this case the first transition border 110) of the first tent section 102 to a narrower width 126 at an end (in this case the second transition border 120) of the second tent section 130.

Within a transition section, such as first transition section 118, when the width varies, the height may (though not necessarily) also vary. Therefore, when widths 116, 126 vary from wider to narrower respectively, than the peak heights 114, 124 at each transition border 110, 120 may also vary from the taller height 114 to the shorter height 124.

Figure 10A:
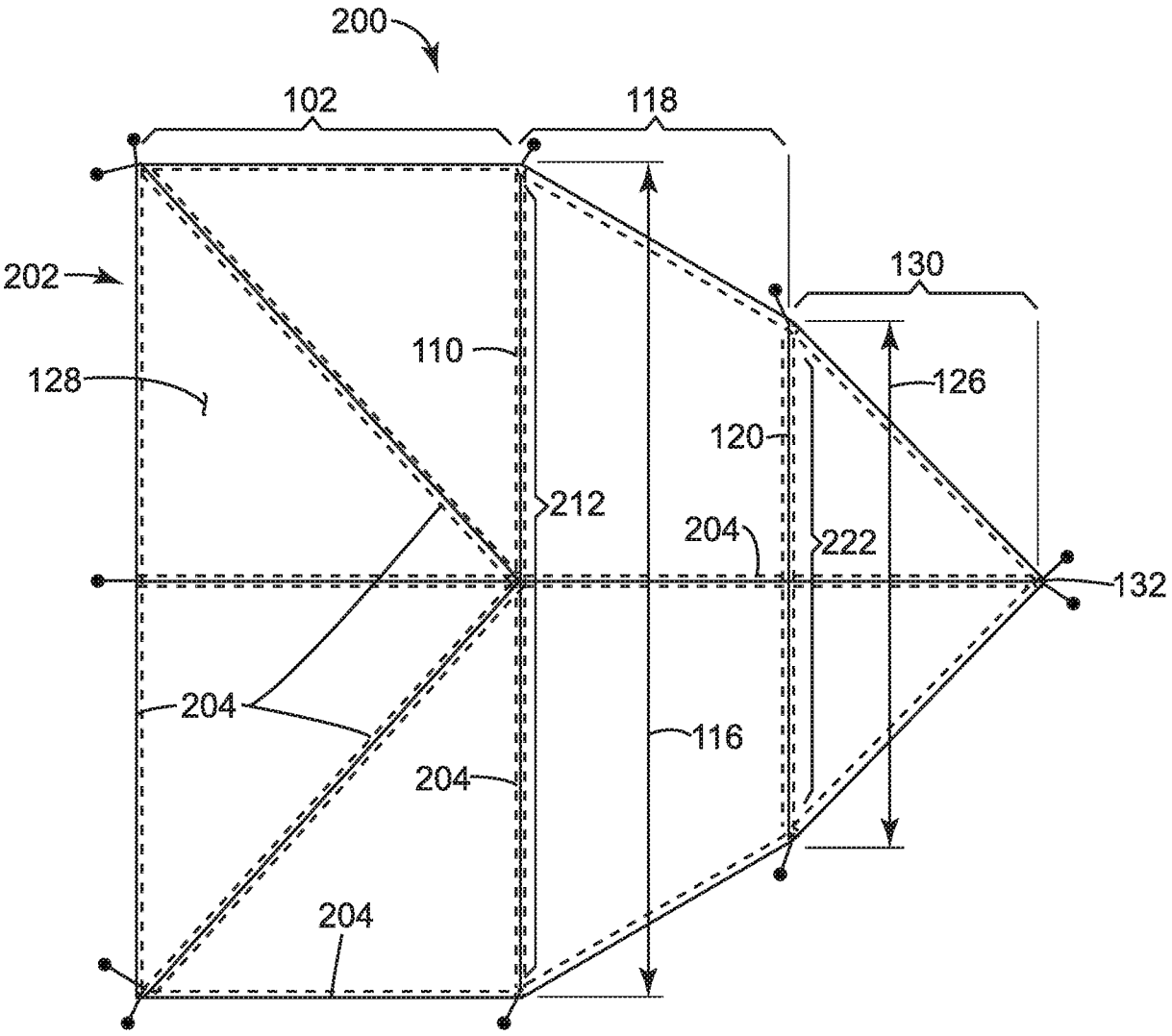
FIG. 10A is a top view of another exemplary embodiment of the frame tent system in accordance with the present invention.

The remaining embodiments in FIGS. 10A and B through 13A and B of tent system 200 are substantially similar to the embodiments in FIGS. 5A-8B of tent system 100 accept that their support members include frames, which may be formed from trusses, or frame poles rather than center poles. Therefore, the description of these embodiments may be summarized as follows.

Figure 10B:
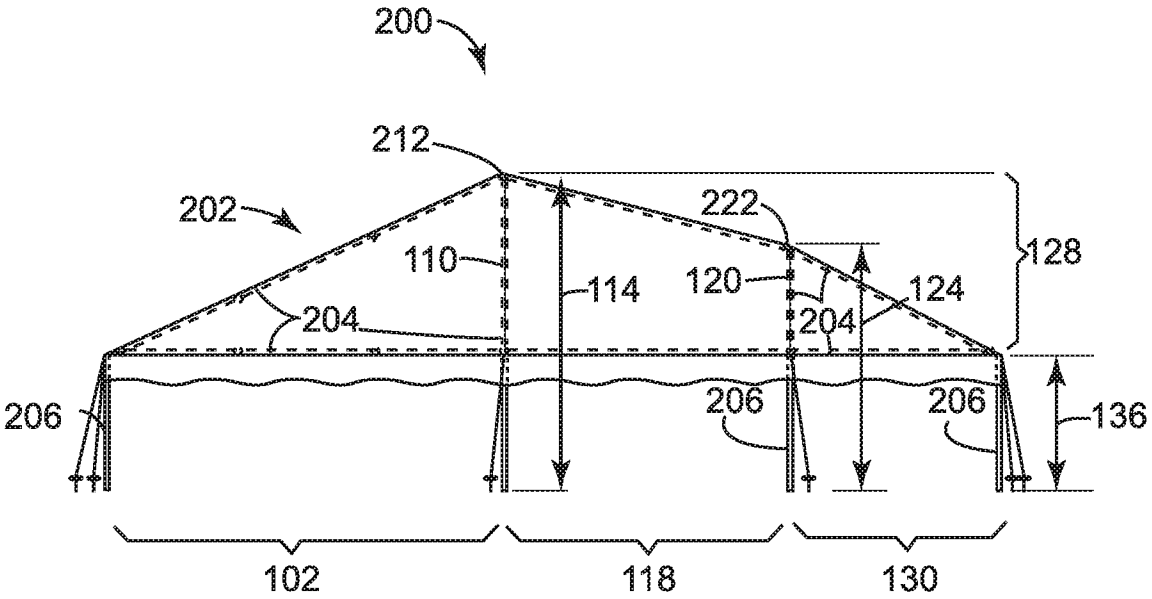
FIG. 10B is a side view of the exemplary embodiment of the frame tent system of FIG. 10A in accordance with the present invention.

The tent system shown in FIGS. 10A and 10B is substantially the same as that shown in the description of FIGS. 5A and 5B except that the first and second support members 212, 222 are frame poles or trusses rather than center poles, wherein the frame poles or trusses acting as support members extend laterally across a peak of the tent roof.

Figure 11A:
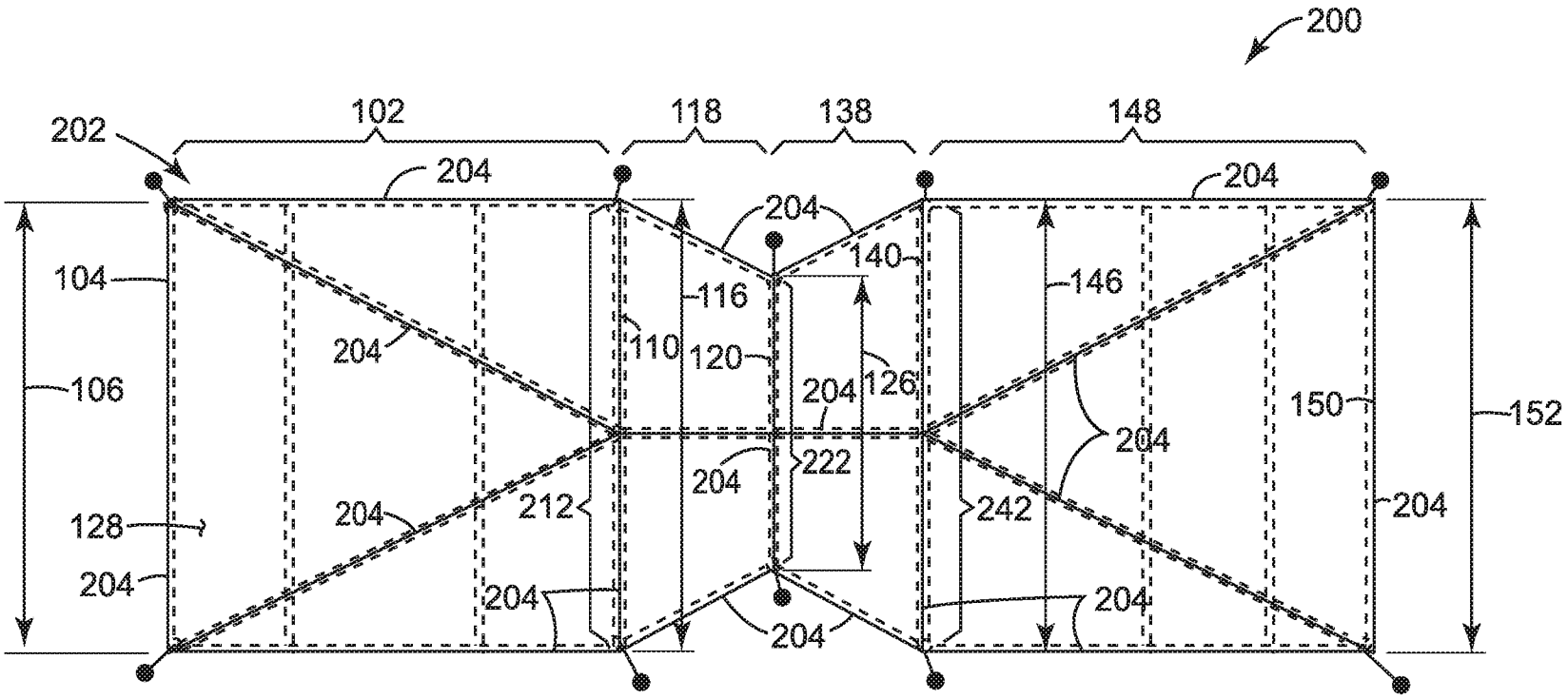
FIG. 11A is a top view of another exemplary embodiment of the frame tent system in accordance with the present invention.
Figure 11B:
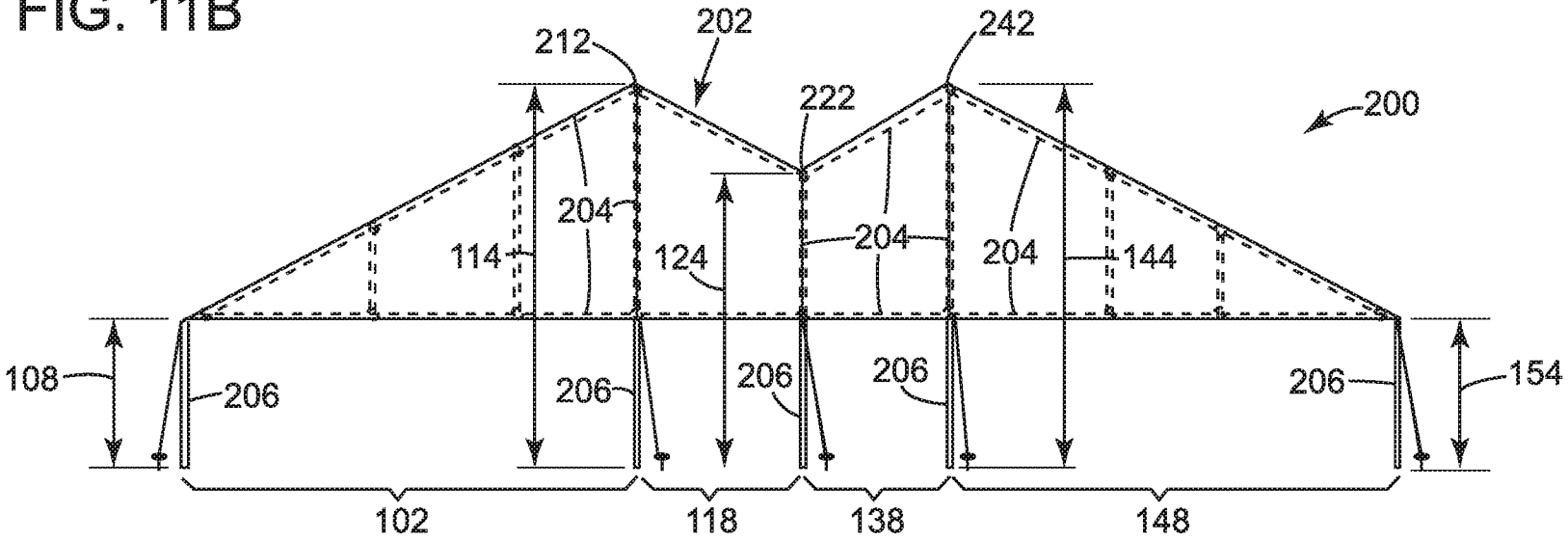
FIG. 11B is a side view of the exemplary embodiment of the frame tent system of FIG. 11A in accordance with the present invention.

The tent system shown in FIGS. 11A and 11B is substantially the same as that shown in the description of FIGS. 6A and 6B except that the first, second and third support members 212, 222, 242 are frame poles or trusses rather than center poles, wherein the frame poles or trusses acting as support members extend laterally across a peak of the tent roof.

Figure 12A:
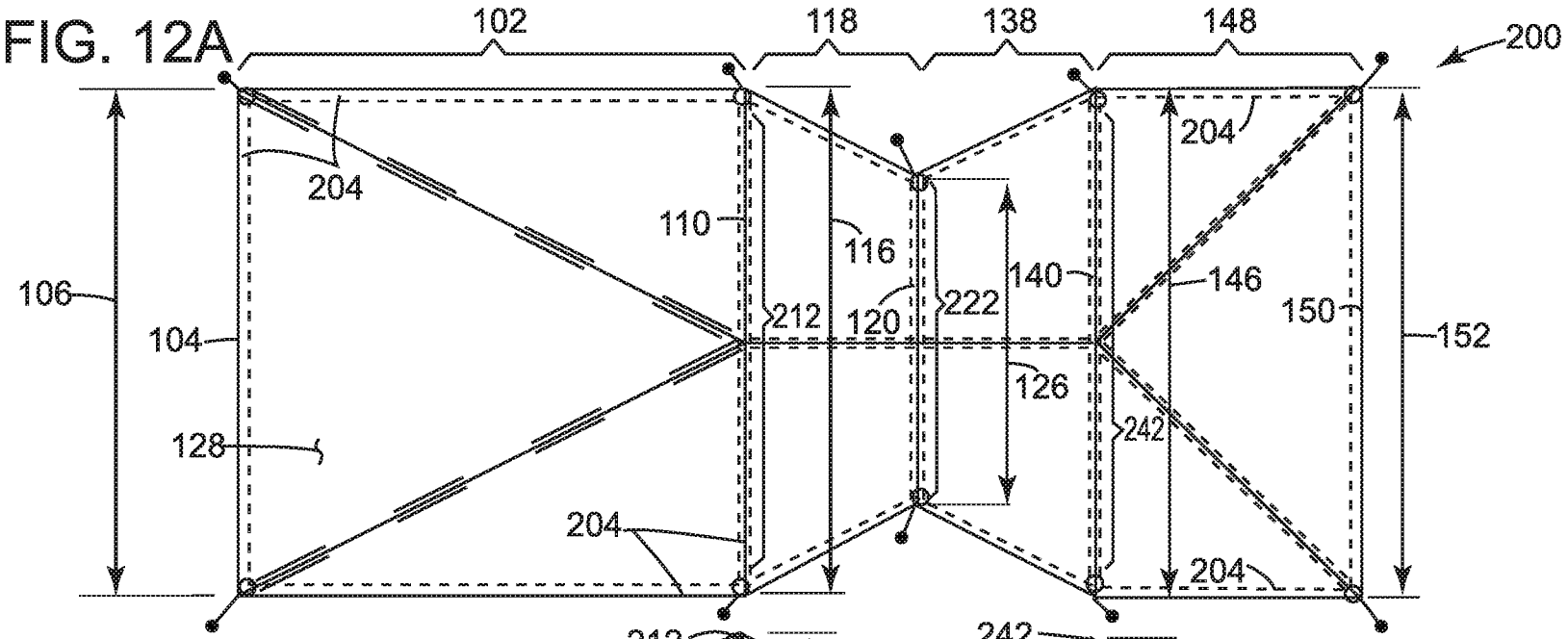
FIG. 12A is a top view of another exemplary embodiment of the frame tent system in accordance with the present invention.
Figure 12B:
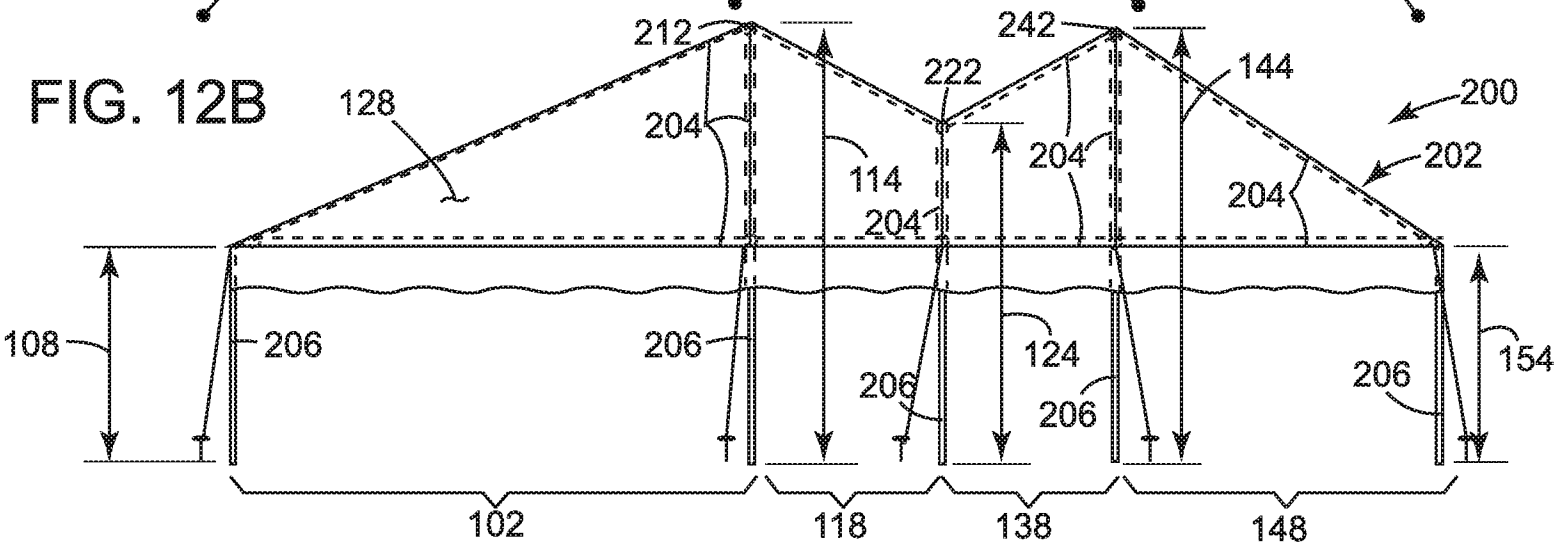
FIG. 12B is a side view of the exemplary embodiment of the frame tent system of FIG. 12A in accordance with the present invention.

The tent system shown in FIGS. 12A and 12B is substantially the same as that shown in the description of FIGS. 7A and 7B except that the first, second and third support members 212, 222, 242 are frame poles or trusses rather than center poles, wherein the frame poles or trusses acting as support members extend laterally across a peak of the tent roof.

Figure 13A:
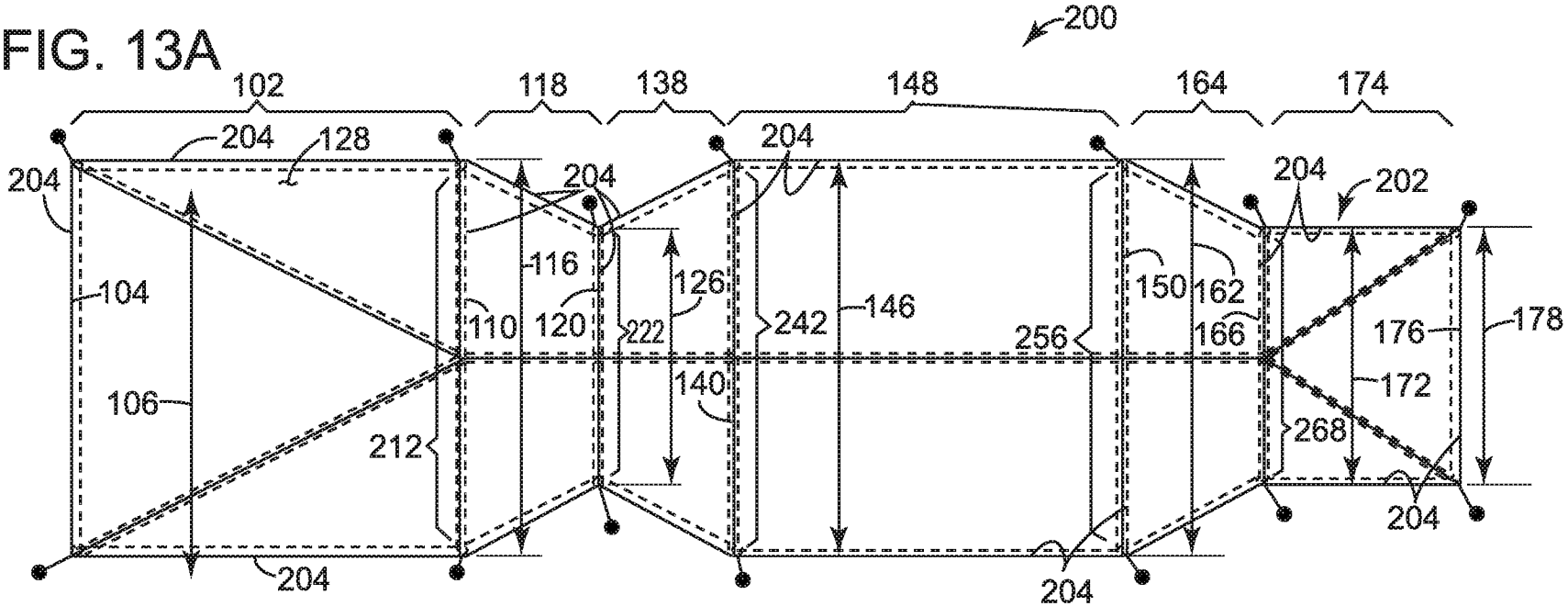
FIG. 13A is a top view of another exemplary embodiment of the frame tent system in accordance with the present invention.
Figure 13B:
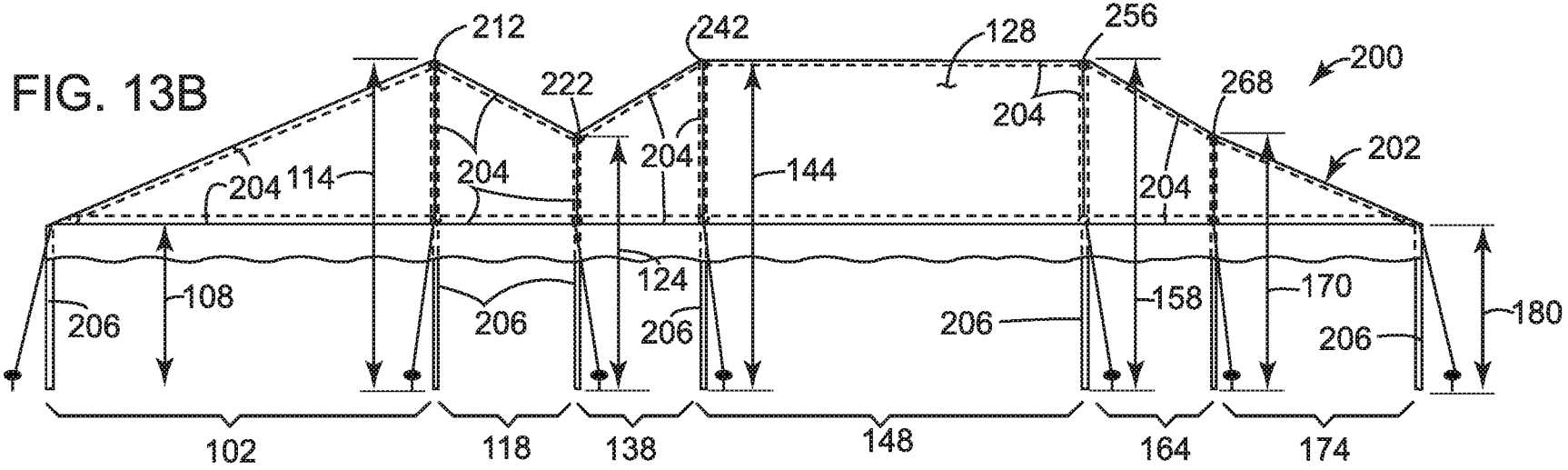
FIG. 13B is a side view of the exemplary embodiment of the frame tent system of FIG. 13A in accordance with the present invention.

The tent system shown in FIGS. 13A and 13B is substantially the same as that shown in the description of FIGS. 8A and 8B except that the first, second, third, fourth and fifth support members 212, 222, 242, 256, 268 are frame poles or trusses rather than center poles, wherein the frame poles or trusses acting as support members extend laterally across a peak of the tent roof.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A tent system comprising:

a first tent section defined by a first tent section end and a first transition border the first transition border having a first transition width;

the first transition border configured to receive a first support member at a first transition height;

a first transition section defined by the first transition border and a second transition border, the second transition border configured to receive a second support member at a second transition height, the second transition border having a second transition width;

wherein the second transition width is substantially narrower than the first transition width and the second transition height is substantially shorter than the first transition height;

a second tent section defined by the second transition border and a second tent section end, the second tent section end having a second tent section end width and a second tent section end height;

wherein the second tent section end width is substantially narrower than the first transition width, the second tent section end height is substantially shorter than the first transition height and the second tent section end height is less than the second transition height; and a tent cover configured to form a unitary roof cover over the first tent section, first transition section and second tent section.

2. The tent system of claim 1, comprising the second tent section end width being substantially equal to the second transition width.

3. The tent system of claim 1, comprising a flexible roof configured to cover the entire tent system.

4. The tent system of claim 1, wherein the support members include center poles.

5. A tent system comprising:

a first tent section defined by a first tent section end having a first tent section end width and a first transition border having a first transition width, wherein the first transition width is substantially equal to the first tent section end width;

the first transition border configured to receive a first support member at a first transition height, the first support member being one of a center pole and a portion of a frame;

a first transition section defined by the first transition border and a second transition border, the second transition border configured to receive a second support member at a second transition height, the second support member being one of a center pole and a portion of a frame, the second transition border having a second transition width;

wherein the second transition width is substantially narrower than the first transition width;

wherein the second transition height is substantially shorter than the first transition height;

a second tent section defined by the second transition border and a second tent section end, the second tent section end having a second tent section end width and a second tent section end height;

wherein the second tent section end width is substantially narrower than the first transition width;

wherein the second tent section end height is substantially shorter than the first transition height; and wherein a tent cover is configured to form a unitary roof cover over the first tent section, the first transition section and the second tent section.

6. The tent system of claim 5, comprising:

a flexible roof configured to cover the entire tent system; and a plurality of side poles disposed along a perimeter of the tent system to elevate and support the roof off of a ground by a height of the side poles.

7. A tent system comprising:

a first tent section defined by a first tent section end and a first transition border, the first transition border having a first transition width;

the first transition border configured to receive a first support member at a first transition height;

a first transition section defined by the first transition border and a second transition border, the second transition border configured to receive a second support member at a second transition height, the second transition border having a second transition width;

a second tent section defined by the second transition border and a second tent section end, the second tent section end having a second tent section end height;

wherein:

the second transition width is substantially narrower than the first transition width, the second transition height is substantially shorter than the first transition height, and the second tent section end height is substantially shorter than the second transition height; and a tent cover configured to form a unitary roof cover over the first tent section, first transition section and second tent section.

8. The tent system of claim 7, wherein the second tent section comprises:

a second transition section defined by the second transition border and a third transition border, the third transition border configured to receive a third support member at a third transition height that is greater than the second transition height, the third transition border having a third transition width that is greater than the second transition width; and wherein the tent cover is configured to form a unitary roof cover over the first tent section, the first transition section and the second transition section.

9. The tent system of claim 8, wherein the second tent section further comprises:

a third tent section defined by the third transition border and the second tent section end, and wherein the tent cover is configured to form a unitary roof cover over the first tent section, the first transition section, the second transition section, and the third tent section.

* * * * *